United States Patent [19]

Ondrus, Jr. et al.

[11] Patent Number: 4,467,566

[45] Date of Patent: Aug. 28, 1984

[54] VALVE SEAT GRINDING DEVICE AND TOOL FOR USING SAME

[75] Inventors: Joseph F. Ondrus, Jr., Affton; John J. Schimweg, St. Charles, both of Mo.

[73] Assignee: Sunnen Products Company, St. Louis, Mo.

[21] Appl. No.: 343,824

[22] Filed: Jan. 29, 1982

[51] Int. Cl.[3] ..... B24B 19/00

[52] U.S. Cl. ..... 51/241 VS; 51/169

[58] Field of Search ..... 51/241 VS, 241 R, 169; 76/DIG. 11, DIG. 12

[56] References Cited

U.S. PATENT DOCUMENTS

| | | | |
|---|---|---|---|
| 1,314,005 | 8/1919 | Louden | 51/169 |
| 1,924,958 | 8/1933 | Patterson | 51/241 VS |
| 2,139,887 | 12/1938 | Dunn | 51/241 VS |
| 2,203,142 | 6/1940 | Haas | 51/241 VS |
| 2,252,223 | 8/1941 | Walraven | 51/241 VS |
| 2,258,505 | 10/1941 | Densmore | 51/241 VS |
| 2,525,119 | 10/1950 | Dunn | 51/241 VS |
| 2,611,223 | 9/1952 | Emge | 51/241 VS |
| 2,769,287 | 11/1956 | Arp | 51/241 VS |
| 2,795,904 | 6/1957 | Arp | 51/241 VS |
| 3,894,673 | 7/1975 | Lowder et al. | 76/DIG. 12 |
| 4,117,968 | 10/1978 | Naidich et al. | 76/DIG. 12 |

FOREIGN PATENT DOCUMENTS

| | | | |
|---|---|---|---|
| 2357629 | 5/1975 | Fed. Rep. of Germany | 51/169 |

*Primary Examiner*—Roscoe V. Parker

*Attorney, Agent, or Firm*—Haverstock, Garrett & Roberts

[57] ABSTRACT

A tool and a grinding member for installing thereon comprising a support structure having inner and outer portions journaled for relative rotational movement, a guide member for mounting on an object having a surface to be ground, the guide member having a cylindrical portion that extends from the object in a position centered on the axis of the surface to be ground, the inner portion of the support structure having a surface for making sliding engagement with the cylindrical guide portion, a work engaging member for mounting on the outer portion of the support structure in position to engage the surface to be ground when the tool is moved axially along the cylindrical portion of the guide member, the work engaging member having a surface portion contoured to the desired shape of the surface to be ground and having surface grooves formed therein at spaced locations extending thereacross, and a layer of relatively hard, wear resistant materials and a binder formed on the contoured surface of the work engaging member.

34 Claims, 16 Drawing Figures

VALVE SEAT GRINDING DEVICE AND TOOL FOR USING SAME

Many tools and other devices have been made and used to grind the valve seats of internal combustion engines and like devices. The known devices have been widely used with varying degrees of difficulty, accuracy and success. It has long been recognized, however, that the accuracy and characteristics of the surface of the valve seats in an engine are important to the operating efficiency of the engine, and even small imperfections will cause leakage and loss of compression which will adversely effect engine efficiency and will cause seat deterioration and wear.

One of the main problems with known valve seat grinding tools is that the abrasive portions which are the portions that do the grinding are themselves subject to relatively substantial wear, change of shape and fragmentation during grinding. This has meant that the abrasive portions of the known devices have enjoyed relatively short life, their shapes have undergone changes as they are being used and used up, they require relatively frequent dressing to restore their shape, and they are usually operated in a dry condition which produces dust and fragmentation that can adversely effect the accuracy of the grinding operation. Dressing of the abrasive members can be especially burdensome and is generally required for two distinct reasons. First, when a conventional grinding wheel is bonded hard enough to maintain its shape, the bond does not allow for dull abrasive grains to dislodge and sharp grains to surface. Dull abrasive wheels also tend to require high cutting forces which in turn allow eccentricity to remain between the valve guide and the valve seat. In other words there is a tendency for the piloting arbor to bend under high cutting forces which often is a serious disadvantage. In these cases dressing is required to restore sharp abrasive grains to the cutting surface.

Secondly, if a conventional grinding wheel is bonded soft enough to permit dull grains to become disloged and to permit sharp grains to surface, the wheel wears too rapidly and loses its shape. The desired valve seat profile then deteriorates, and, dressing is required to restore the wheel to its intended shape.

In either case the dressing required is time consuming and it substantially shortens the life of the grinding wheel since dressing usually takes away more of the grinding wheel than is worn away during the grinding operations. Dressing also creates a dusty, gritty environment which can be hazardous to health. These and other disadvantages and shortcomings of the known devices are magnified by the fact that when grinding a plurality of valve seats it is usually necessary to make frequent changes and adjustments when going from grinding seats of one set of characteristics to grinding different seats, and also when changing from grinding different surfaces on the same seats.

The present invention teaches the construction and operation of improved means for grinding valve seats which means overcome the shortcomings and disadvantages of the known devices as set forth above. In particular the present invention teaches the use of novel abrasive members for grinding valve seats and like surfaces, which members are plated members, preferably accurately plated with a substance that includes particles having extremely hard wear resistant characteristics such as diamond particles, particles of cubic boron nitride and certain other substances. When such substances are plated on the work engaging portions of the present devices the devices never again need to be dressed to maintain their accuracy; they can be operated while in a wet or oily environment so that little or no dust is produced in the grinding process; they can be used in association with novel means for supporting and accurately guiding the abrasive members during operation to maintain alignment and positional accuracy; they produce relatively fast stock removal rates, and the valve seat surfaces that are ground by the present devices have minimal amounts of stock removed from them and they have excellent surface accuracy and surface characteristics, and the need to prepare a surface in advance using roughing stones, as frequently required in the past, is eliminated. With the present construction it is also possible to change abrasive members quickly and easily so that a minimum amount of time and labor is required to accurately grind a set of valve seats. Furthermore, if other work is to be performed on the engine at the time when the valve seats are to be ground such as reconditioning the bores or valve guides in which the valve stems move, the fact that the engine may already be wet will not prevent operation of the present valve seat grinding device since the present device is preferably, although not necessarily, operated wet. As indicated, grinding valve seats while wet reduces or eliminates the production of dust and other particles including abrasive grit which is an advantage. Also, the present device produces little or no loose abrasive grit during operation and this is due to the hardness of the particles employed in the abrasive layer and to the way in which the abrasive layer is formed and attached. Furthermore, the present abrasive members produce excellent runout characteristics which is a measure of the roundness and concentricity of the valve seat surfaces after grinding and this is an important advantage that contributes to the accuracy and to the sealing properties of the ground valve seats.

The present invention, in addition to teaching the construction and operation of novel abrasive members, is also directed to improved means for supporting, guiding, and driving the abrasive members, which means include the use of guide members that are temporarily installed in the valve guides. Furthermore, the subject improved means can be powered by a readily available power source such as by a portable hand tool such as an electric drill, and the power source can be coupled to drive the subject abrasive members through coupling connection means which enable some free relative angular movement between the electric drill and the means to which the abrasive member is attached. The use of such coupling means prevents binding, enables a freer and less rigid operation and contributes to the accuracy including the improved runout of the surfaces being ground.

It is an important object of the present invention to provide more accurate means for grinding valve seats and like surfaces.

Another object is to provide a grinding device that has relatively long life characteristics and does not require periodic dressing to maintain the accuracy of its grinding surfaces.

Another object is to enable grinding valve seats in a wet condition.

Another object is to substantially reduce or eliminate contaminating an engine by dust, abrasive particles, and other foreign matter during the grinding of the engine valve seats.

Another object is to greatly reduce or entirely eliminate the need to rough grind valve seats.

Another object is to reduce the time and labor required to grind the valve seats of an engine or like device.

Another object is to provide improved means for coupling a power source to a rotatable tool used for grinding valve seats.

Another object is to provide a valve seat grinding tool that produces improved runout characteristics of valve seats ground thereby.

Another object is to reduce the time and labor required to change grinding members used in the grinding of the different surfaces of valve seats.

Another object is to increase the operating efficiency of internal combustion engines.

Another object is to reduce the time and labor required to prepare an engine to have its valve seats ground.

Another object is to provide abrasive valve seat grinding members that have cutting surfaces formed by spaced portions arranged in a way to improve the operational accuracy and the cutting efficiency.

Another object is to provide a relatively small, portable valve seat grinding tool which can be coupled for use with an existing power source such as an electric drill.

Another object is to facilitate replacing grinding members on a valve seat grinding tool.

These and other objects and advantages of the present invention will become apparent to those skilled in the art after considering the following detailed specifications of preferred embodiments thereof in conjunction with the accompanying drawings wherein.

Figure 1:
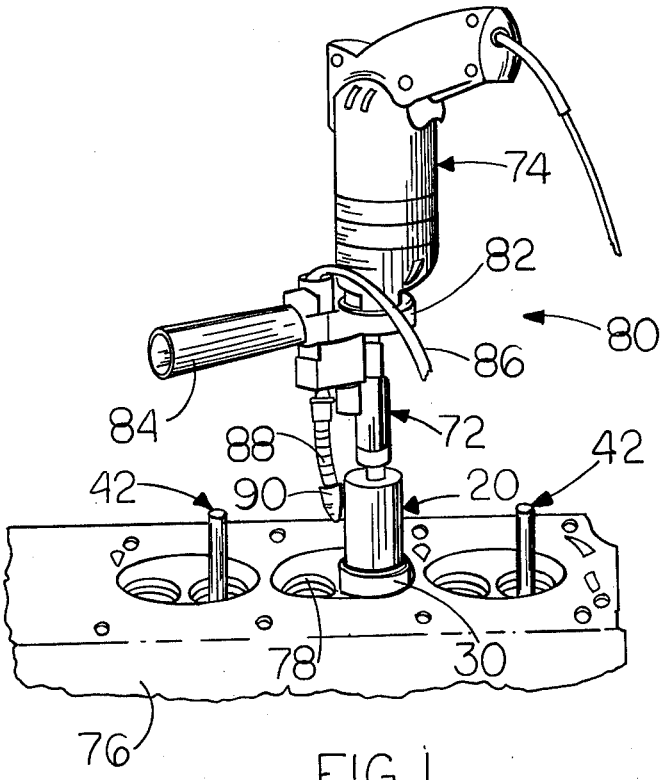
FIG. 1 is a front elevational view showing a portion of a cylinder head with one of its valve seats being ground by a grinding device including by an abrasive member and the support means therefor constructed according to the present invention.
Figure 2:
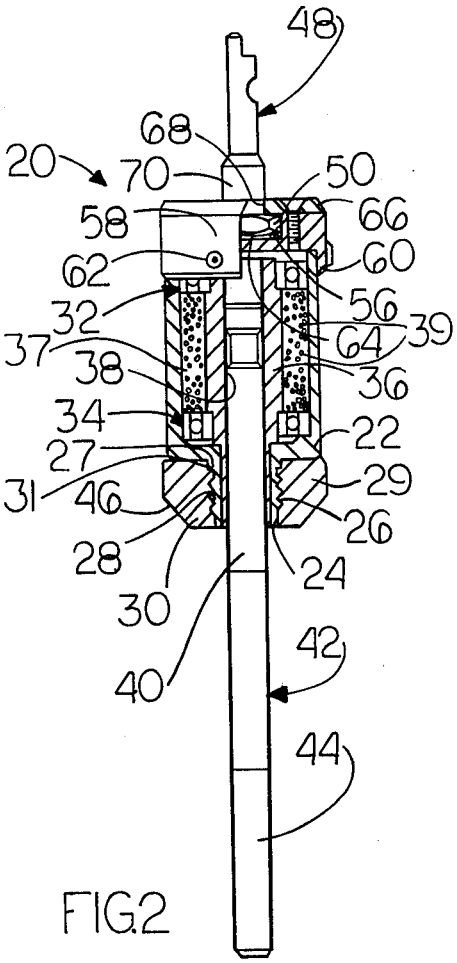
FIG. 2 is a cross-sectional view of the subject valve seat grinding tool with an abrasive member mounted thereon and with the tool shown cooperating with a guide member.

Referring to the drawings more particularly by reference numbers, number 20 in FIGS. 1 and 2 identifies a tool for use in grinding annular surfaces such as the annular tapered seat surfaces of valve seats in internal combustion engines. The tool 20 as shown in FIG. 2 includes an elongated cylindrical housing 22 which has a reduced diameter end portion 24 with threads 26 (FIG. 5) formed on its outer surface. The housing 22 also has an annular locating shoulder 27 and an end surface 29 which extends outwardly from the shoulder 27 at a right angle to the housing axis. The threads 26 cooperate with threads 28 formed on the inner surface of an annular work engaging abrasive member 30 (See FIGS. 7, 10, 11 and 12 for examples). The inner surface of the members 30 also has a counterbore 31 which engages the shoulder 27 when the member 30 is installed to enable the counterline of the member 30 to align itself to housing 22. When the member 30 is fully installed it will also abut the housing end surface 29 to maintain itself in proper installed position in the housing. A washer 33 (FIG. 5) may also be provided if desired. The details of the member 30 are important to the invention and several different embodiments are described hereinafter.

Figure 6:
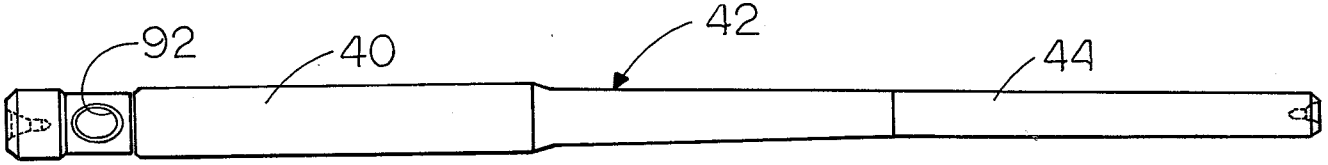
FIG. 6 is a side view of a guide member for use with the subject tool.

The housing 22 contains a pair of spaced bearing assemblies 32 and 34, the outer races of which are engaged with the inner surface of the housing 22 and the inner races with the outer surface of an elongated tubular member 36. An annular space 37 is formed by and between the housing 22, the member 36 and the spaced bearing assemblies 32 and 34. It is usually preferred that the space 37 be filled with a substance such as a plurality of shot or like members 39 or with a viscous fluid or a combination thereof to increase the moment of inertia to improve the operating characteristics of the device by reducing undesireable vibration. The member 36 has a cylindrical inner surface 38 which is sized to slideably cooperate with a cylindrical end portion 40 of a guide member 42 (FIG. 6). The guide member 42 has an opposite end portion 44, usually somewhat smaller in diameter than the portion 40, that is sized to be positioned in a valve guide of an engine block or head associated with a valve seat to be ground by the subject device. The member 42 is therefore used as a guide for movably supporting and accurately locating the work engaging member 30, and particularly work engaging surface 46 thereof, during a grinding operation.

In the construction shown in FIG. 2, the abrasive member 30 is threaded onto the threads 26 of the reduced diameter housing portion 24, and during this attachment the shoulder 27 slideably cooperates with the counterbore 31 as aforesaid to align the member 30 thereon. During operation of the device, the housing 22 including the reduced diameter portion 24 and the abrasive member 30 threadedly attached thereto, are rotated relative to the inner tubular member 36. The drive means for operating the subject device are coupled thereto by means of a member 48, FIGS. 2–5, which member has a hexagonal shaped head portion 50 and an elongated body portion 52. The head portion 50 has a rounded end surface 54, and is positioned in a hexagonal shaped socket 56 provided therefor in a housing closure member 58 which is attached to one end of the tubular housing 22. This attachment is made by an annular flange 60 which fits onto the housing 22, and is made secure by suitable means such as by threaded members 62.

The hexagonal cavity or socket 56 also receives an annular elastomeric washer 64 against which the rounded end surface 54 is engaged. The end of the device 20 is closed by an annular closure wall 66 which has a central opening 68 that is large enough to cooperatively receive cylindrical portion 70 of the member 48 but is not large enough for the hexagonal head portion 50 to pass through. Some clearance should be provided between the opening 68 and the portion 70 so that the member 48 is allowed some limited angular movement relative to the housing members 22, 24, 58, and 66.

Figure 3:
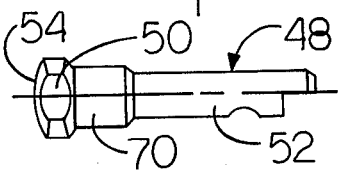
FIG. 3 is a side elevational view of the portion of the tool of FIG. 2 that is used to couple to a power source.
Figure 4:
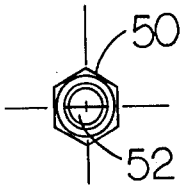
FIG. 4 is right end view of the coupling member of FIG. 3.

The member 48, as shown in FIGS. 2 and 3, is shaped to couple to a drive source such as to a chuck portion 72 of an electric drill 74 as shown in FIG. 1. The shape of the end of the member 48 opposite the hexagonal head 50 is to enable quick connection and release. When so coupled some relative angular movement is possible between the drill 74 and the device 20. This is important and helpful to the operation by preventing binding while maintaining alignment between the member 30 and the valve seat surface being ground thereby. This limited free movement also eliminates rigidity between the drill and the tool 20 except for the member 48 which is rigidly attached to the drill, and greatly improves the runout characteristics of the surface being ground. As indicated, during operation the device 20 is slidably engaged with the cylindrical end portion 40 of the guide member 42 while the opposite or lower end portion 44 of the guide member 42 as shown in FIG. 1 is anchored in position in a valve guide in the head 76. If no free play were provided between the tool and the power source there would be much greater tendency for unwanted stiffness or rigidity and possible vibration of the tool which could adversely affect the surface accuracy and runout characteristics of the valve seat being ground.

Referring again to FIG. 1, the total assembly 80 is shown in operating condition and as shown includes a support ring assembly 82 with a handle 84 thereon for support and guidance control, and means attached thereto for supporting a lubrication tube 86 which communicates with a flexible tubular outlet end portion 88 that is connected to a nozzle assembly 90. The tube 86 and the portions 88 and 90 provide means to direct a stream of lubricant such as a stream of cutting oil to the area being ground. So far as is known it has not been the practice heretofore to wet grind valve seats and because of this the known constructions cause substantial stone and part wear producing dust and other foreign substances including abrasive particles that can enter the engine and cause operating trouble such as engine wear and the like. This is not a problem with the present device, however, because the present device removes substantially less material from the part being ground and little or no dust or crumbling of the abrasive member takes place as will be explained more in detail hereinafter, and with the present device it is not usually necessary to employ a roughing operation step ahead of the final sizing and finishing operation.

Referring again to FIG. 2, when the member 48 is coupled to the drill 74 as shown in FIG. 1, power is transmitted from the drill to the member 48 and from the hexagonal head portion 50 thereof to the housing members 58, 22, and 24, to the grinding member 30. Any forward or advancing pressure applied from the drill 74 is applied through the rounded surface 54 on the head 50 to the annular washer 64. This provides a smooth acting connection which has some cushioning, and enables some limited angular movement of the drill relative to the tool 20 to prevent stiffness or rigidity between the power source and the guide member 42. The inner tubular member 36 is slidably mounted on the cylindrical end portion 40 of the guide 42 and this movement can be non-rotatable and mainly serves to accurately position, align and locate the abrasive member as it moves axially along the guide 42 and into engagement with the valve seat surface to be ground. The bearing assemblies 32 and 34 enable relative rotational movement between the housing 22 including the abrasive member 30 and the tubular member 36 and also enables grinding power to reach the abrasive member 30 as it is rotated and moved axially into engagement with the valve seat.

Figure 5:
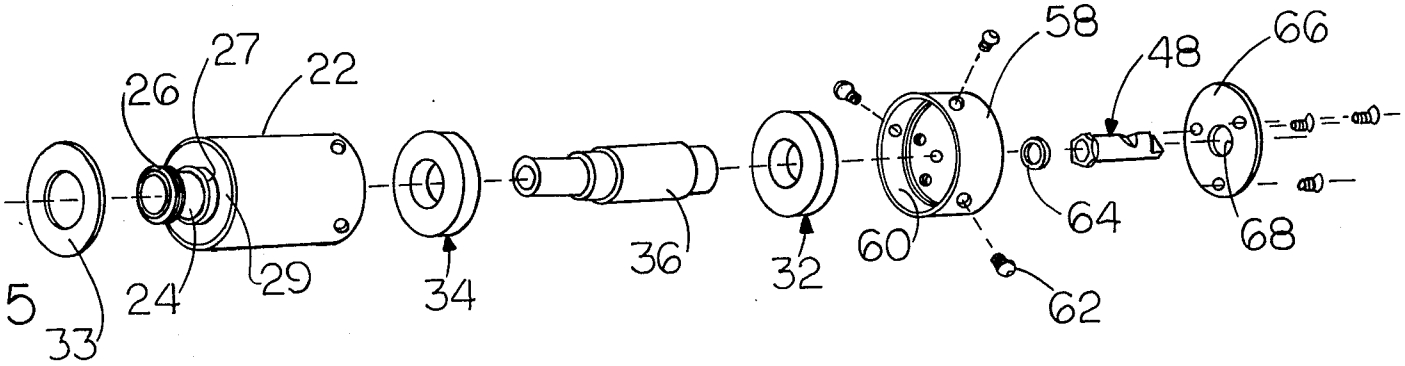
FIG. 5 is an exploded view of the subject tool.

In FIG. 5, the parts of the assembly 20 are shown in exploded view for better understanding and to better illustrate how the parts are assembled. The various parts shown in FIG. 5 are numbered to correspond to the same parts as shown in the other drawing figures.

In FIG. 6 is shown a typical shape for the guide member 42 which has one end portion 44 for positioning in a valve guide and an opposite end portion 40 that allows the subject device to move axially in the cylindrical inner surface 38 of the tubular member 36 when being used. The portion 44 may be slightly tapered end to end to enable making a secure connection when inserted in the valve stem bore, and the portion 40 is cylindrical in shape to facilitate relatively free axial movement of the device 20 therealong. The cylindrical portion 40 as shown in FIG. 6 has a cross bore 92 therethrough near its end and a lever or rod member (not shown) can be inserted through the cross bore 92 and used to rotate the guide member 42 when it is positioned in a valve guide to make a tight fit therein. The same lever or rod can also be used to rotate and loosen the member 42 so that it can be easily withdrawn after it has served its purpose. The shape and size of the guide member 42 as well as other parts can all be varied depending on the size of the valve guide and the size of the valve seat to be ground.

Figure 16:
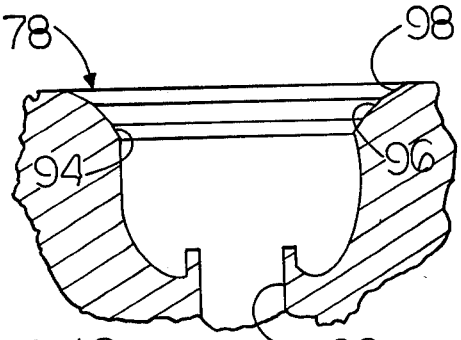
FIG. 16 is an enlarged fragmentary cross-sectional view taken through the center of an engine valve seat whose surfaces are to be ground by the subject device.

Of special importance to the present invention are the structural details of the grinding member 30. Several different embodiments of the member 30 are disclosed and will be discussed including embodiments used to grind different angularly related portions of valve seats. Many valve seats are formed by three adjacent surfaces to be ground all of which are at different angles. In order to grind such a construction it is important to grind each different surface portion, and this will require several different grinding operations to complete the grinding. This will also require using several different grinding members which are distinguishable from each other by having their grinding surfaces oriented at different angles. A typical valve seat 78 to be ground is shown in FIG. 16. The seat 78 is formed by three annular surface portions including an annular inner surface portion 94 which is shown oriented at a relatively shallow angle such as at an angle of 30° to the axis of the valve seat, a second annular seat portion 96 which is the valve seat portion that is engaged by an engine valve member during operation shown oriented at 45° to the axis, and a third outer annular seat portion 98 shown oriented at a steeper angle such as at 60° (or 75°) to the axis. FIG. 16 also shows a portion of a valve guide 100 into which the portion 44 of the guide member 42 is positioned during operation of the subject tool.

In order to grind the valve seat 78 of FIG. 16, it is necessary to use three different grinding members similar to the grinding member 30 each having its grinding surface oriented to grind the respective valve seat portions 94, 96, and 98. However, each of the different grinding members can be mounted for use on the same tool 20, using the same guide member 42, and in a series of operations which usually includes grinding the contact surface 96 and thereafter grinding the inner and outer relief surfaces 94 and 98. It is also possible to grind the relief surfaces 98 and 94 before grinding the contact surface 96. If the relief surfaces 98 and 94 are ground first, the final grinding operation will then restore the contact surface 96 to its desired width and shape. It should be apparent that when using the subject tool the total amount of the material removed during the grinding operations will be very small.

In a situation where all of the intake and exhaust valve seats in an engine are to be ground, it is expected that a similar guide member 42 will be positioned extending outwardly from each valve seat in the engine head so that all of the valve seat surface portions of each type can be ground with the same grinding member on the tool. This means, for example, that all of the seat surfaces of the valve seats associated with the inlet ports will be ground in one series of operations and all of the seat surfaces of the valve seats associated with the exhaust ports will be ground in another series of operations. This also means that an engine can be prepared in advance to have all of its valve seat surfaces ground in minimum time and with a minimum of changes in the grinding members. Furthermore, some valve seats may have only one or two seat portions that need to be ground, and the present device is equally able to be used for grinding these.

Figure 7:
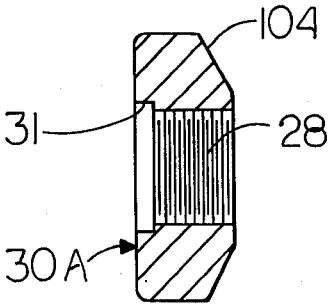
FIG. 7 is a cross-sectional view through the center of an abrasive member for use on the subject tool.

In FIGS. 7–15 are shown the details of construction of several different forms of the grinding member 30. In FIG. 7 the grinding member 30A is shown having a threaded bore 28 for engaging the threads 26 on the reduced diameter portion 24 of the housing 22 and a locating surface or counterbore 31 for engaging the housing shoulder 27. The grinding member 30A has an annular tapered work engaging surface 104 which is the work surface, and this surface is formed by plating on the member 30A a layer of a hard wear resistant material such as a layer formed of diamond particles or particles of cubic boron nitride in a binder. Many different kinds of cubic boron nitride are available commercially and are suitable for use on the subject grinding members including especially the microcrystalline cubic boron nitrides.

Figure 9:
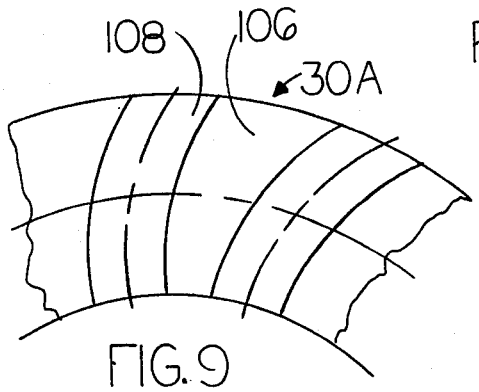
FIG. 9 is an enlarged fragmentary view of a portion of the abrasive surface of the member in FIGS. 7 and 8.
Figure 8:
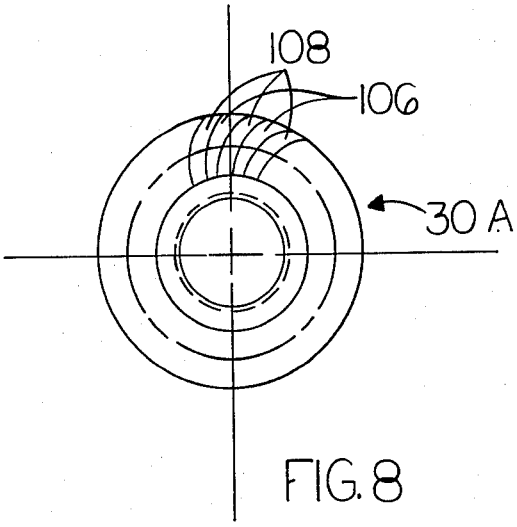
FIG. 8 is a right side view of the abrasive member of FIG. 7.

The work engaging grinding surface 104, shown in greater detail in FIGS. 8 and 9, is formed by a plurality of radially curved grinding surface areas 106 separated by radially curved grooves 108 that extend between the adjacent areas 106 around the grinding surface 104. The grooves 108 are shown uniformly spaced and of uniform width along their lengths which means that the abrasive areas 106 therebetween become progressively wider from their radially inner to their radial outer edges. It is also possible to make the areas 106 of uniform width in which case the grooves 108 will become progressively wider from their inner to their outer ends. The grooves 108 serve as channels for the removal of material during grinding, and they also facilitate the circulation of lubricant during the grinding operation. However, because the surface 104 is formed by being coated with a layer of extremely hard wear resistant particles it undergoes little or no wear, it remains true and accurate in shape even after repeated use, it can be used to grind many valve seat surfaces without the need for any dressing whatsoever and usually accomplishes accurate grinding without the need for any preliminary rough grinding step. The provision of the grooves 108 also serve to more uniformly distribute and increase the grinding rate and to circulate lubricant and to carry away the chips or fragments, and produces a highly desirable operating condition not heretofore obtainable with known devices or with devices that have continuous annular grinding surfaces which are grinding surfaces without grooves. In FIG. 7 the grinding surface 104 is shown oriented at 60° to the axis of the member 30A.

Figure 10:
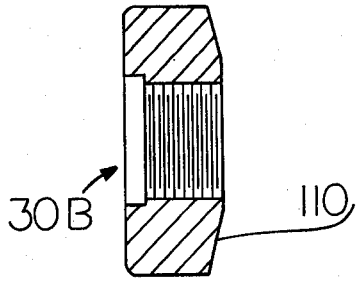
FIGS. 10 and 11 are cross-sectional views of other valve grinding members similar to that shown in FIGS. 7 and 8 but having different orientations for the work engaging surfaces.

FIG. 10 shows another form of grinding member 30B which is similar in most respects to the member 30A except that its annular grinding surface 110 is oriented at an angle of 75° to the axis of the element. In a typical valve seat grinding procedure the element 30B would be used to grind the outer valve seat relief surfaces such as the surface portion 98 in FIG. 16 assuming it was at an angle of 75° to the axis.

Figure 11:
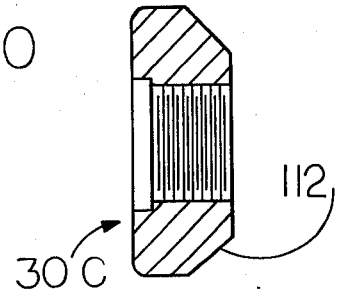

FIG. 11 shows a grinding member 30C which likewise is similar to the members 30A and 30B except for the angular orientation of its annular grinding surface 112 which is oriented at 45° to the axis to grind the annular surface portion 96 of the valve seat shown in FIG. 16.

Figure 12:
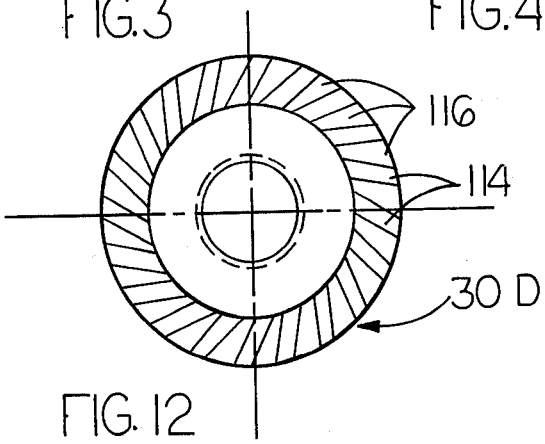
FIG. 12 is a view similar to FIG. 8 showing a different shape for the spaced abrasive surface portions and adjacent grooves.

FIG. 12 is similar to FIG. 8 but shows another grinding member 30D with another distinctive configuration of adjacent grooves 114 and grinding areas 116. In the embodiment 30D the grooves 114 and the adjacent grinding areas abut along straight edges which are angularly oriented relative to radii of the device. In this construction the grooves 114 are shown as being of uniform width along their lengths and the grinding areas are narrowest at their inner peripheries becoming widest at the outer periphery of the grinding surface. This construction has many of the same advantages as the constructions described above in connection with FIGS. 8–11. In some cases, however, it has been found that curved grooves are preferred over straight grooves.

Figure 13:
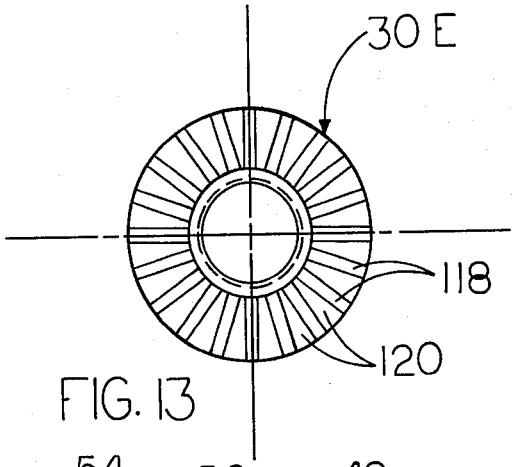
FIG. 13 is another view similar to FIG. 8 showing still another configuration for the spaced work engagihg abrasive surface portions and grooves.

FIG. 13 shows yet another construction 30E in which grooves 118 extend radially outwardly between adjacent grinding surfaces 120. This construction has some manufacturing advantages but in most cases is not preferred over the constructions decribed above.

Figure 14:
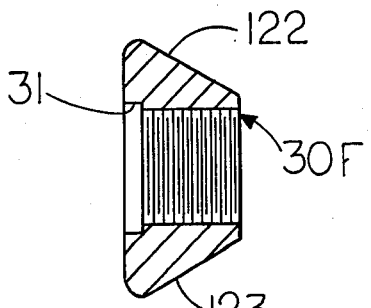
FIG. 14 is a cross-sectional view through the center of yet another abrasive work engaging member.
Figure 15:
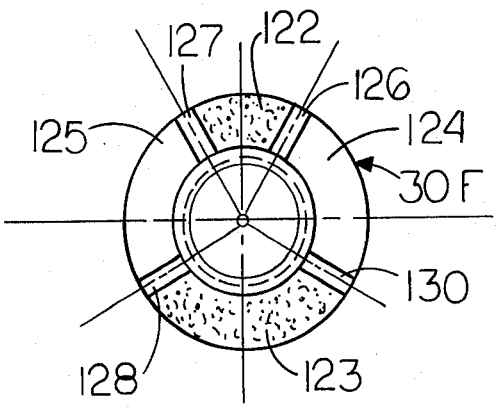
FIG. 15 is a view of the right side of the member of FIG. 14.

FIGS. 14 and 15 are views of yet another embodiment 30F of the grinding member in which spaced grinding surfaces 122 and 123 are shown oriented at 30° to the axis thereof and are formed by being plated in the same way as the grinding surfaces described above. The grinding surfaces 122 and 123 are separated from each other by non-plated regions 124 and 125 and the edges of the plated areas abut surface grooves 126, 127, 128 and 130 arranged in pairs as shown with one pair of the grooves 126 and 127 being spaced apart at about 60° and located on opposite sides of the abrasive surface 122 and the other pair of grooves 128 and 130 are spaced apart at about 120° and located on opposite sides of the abrasive surface 123. It has been found that this arrangement of the grooves 126, 127, 128 and 130 reduces the possibility for chatter and produces valve seat surfaces that are very accurate. The bisectors between the groove pair 126 and 127 and between the groove pair 128 and 130 need not be, and preferably are not, located diametrically opposite as shown but are preferably offset by some angle such as an angle of between about 5° to 10°. The number of grooves in each or both sets of grooves can also be increased, if desired such as by adding grooves extending across the abrasive regions 122 and 123.

In all cases the grooves formed in the grinding surfaces are relatively shallow and are formed with round bottoms although the edges of the grooves can also be formed having relatively steep side edges. The grooves as well as the adjacent grinding surfaces can also be coated with the abrasive particles for economy of construction although in some situations it may be desired to mask the grooves to reduce the amount of abrasive material that is needed. It is also preferred that the cross bores through all of the various abrasive members as disclosed be the same so that the same tool 20 can be used for attaching and driving all of the various embodiments, and the direction of the threads in the various cross bores should be selected so that the grinding pressure will be applied in a direction to tighten the grinding members on the tool.

Thus there has been shown and described a novel valve seat grinding tool and grinding member for use thereon including various embodiments of the grinding member, which fulfill all of the objects and advantages sought therefor. It will be apparent to those skilled in the art, however, that many changes, variations, modifications, and other uses, embodiments, and applications of the subject devices, in addition to those disclosed, are possible. All such changes, variations, modifications, and other uses, embodiments, and applications which do not depart from the spirit and scope of the invention are deemed to be covered by the invention which is limited only by the claims which follow.

What is claimed is:

1. A tool for grinding valve seats in engines and the like comprising a support structure having inner and outer portions with journal means positioned therebetween to enable relative rotational movement therebetween, a guide member for mounting in a valve guide in position extending outwardly from a valve seat to be ground, said guide member having a first portion for positioning in a valve guide and a cylindrical portion extending from the valve guide and located extending through the valve seat and associated surfaces to be ground, means on the inner support structure for slidably engaging the cylindrical portion of the guide member to permit axial movement therealong, an annular metal member having axially spaced opposed end faces and a cylindrical outer surface therebetween, one of said opposed end faces being frusto-conical in shape and contoured to the desired shape of a valve seat surface to be ground thereby, said one end face having a plurality of spaced surface grooves and adjacent surface portions formed thereon, a work engaging surface layer formed of a relatively hard wear resistant material and a binder formed on said one end face of said metal member, means for attaching and aligning the metal member on the outer support portion, said outer support portion having spaced opposite ends one of which includes means for coupling to a drive source for rotating the outer member relative to the inner member and the other includes means for attaching and aligning said metal member thereto for rotation with the outer support portion.

2. The tool of claim 1 wherein the plurality of spaced grooves extend across the one face in substantially radial directions.

3. The tool of claim 1 wherein said contoured end face is annular and has spaced inner and outer peripheral edges, each of the grooves of said plurality of grooves having a curved shape and extending across the contoured end face between the inner and outer peripheral edges extending from a leading end adjacent to the inner peripheral edge to a trailing end adjacent to the outer peripheral edge, the leading end being circumferentially spaced ahead of the trailing end relative to the direction of rotation thereof.

4. The tool of claim 1 wherein the contoured face is annular and has spaced inner and outer peripheral edges, each of the grooves of said plurality of grooves extending radially between the inner and outer peripheral edges.

5. The tool of claim 1 wherein said contoured surface is annular and has spaced inner and outer peripheral edges, each of the grooves of said plurality of grooves extending across the contoured surface between the peripheral edges being oriented at a predetermined acute angle relative to the radius of the surface thereat with the groove ends adjacent to the inner peripheral edge being circumferentially ahead of the respective groove ends adjacent to the outer peripheral edge relative to the direction of rotation of the annular member.

6. A grinding member for grinding valve seat surfaces comprising an annular metal member having a central axial extending passage therethrough, said metal member having spaced axially opposed annular end faces formed thereon, one of which is acutely angularly oriented relative to the axis of the member to form a frusto-conical end face contoured to conform to the contour of a valve seat surface to be ground thereby, said frusto-conical end face having inner and outer peripheral edges and being defined by a plurality of circumferentially spaced surface portions separated by spaced surface grooves which extend between the inner and outer peripheral edges thereof, and a work engaging surface layer formed of particles of a relatively hard wear resistant abrasive material and a binder formed on selected ones of said plurality of spaced surface portions to engage and abrade a valve seat surface to be ground thereby.

7. The grinding member of claim 6 wherein the particles of relatively hard wear resistant material include diamond particles.

8. The grinding member of claim 6 wherein the particles of relatively hard wear resistant material include particles of cubic boron nitride.

9. The grinding member of claim 6 wherein the particles of relatively hard wear resistant material include particles of microcrystalline cubic boron nitride.

10. The grinding member of claim 6 wherein each of the surface grooves is curved in shape.

11. The grinding member of claim 6 wherein each of the surface grooves is oriented to extend in a radial direction across the one surface.

12. The grinding member of claim 6 wherein each of the surface grooves is oriented at an acute angle relative to the radial direction at the location thereof.

13. The grinding member of claim 6 wherein the surface grooves are equally spaced about the one surface.

14. A grinding member for use in grinding annular frusto-conical shaped valve seat surfaces on an engine comprising an annular metal member having an axial passage therethrough and spaced axially opposed annular surfaces at least a portion of one of which is frusto-conical in shape and oriented at an acute angle relative to the axis of the member corresponding to the desired orientation of frusto-conical shaped valve seat surfaces to be ground thereby, said portion of said one surface including a plurality of circumferentially spaced surface portions and surface grooves which extends along opposite sides of each of the spaced surface portions, a work engaging layer formed by particles of a relatively hard wear resistant material and a binder formed on selected ones of said circumferentially spaced surface portions to engage a valve seat surface to be ground thereby, and means including the axial passage through said metal member to enable mounting the member for rotation about the axis thereof.

15. The grinding member of claim 14 wherein the particles of relatively hard wear resistant material include diamond particles.

16. The grinding member of claim 14 wherein the particles of relatively hard wear resistant material include particles of cubic boron nitride.

17. The grinding member of claim 14 wherein the surface grooves extend across the said one opposed surface of the metal member between adjacent spaced surface portions and are curved in shape.

18. The grinding member of claim 14 wherein the grooves extend radially across said one surface portion.

19. The grinding member of claim 14 wherein each of the grooves extends across said one surface portion at acute angles relative to the radius of the member at the location thereof.

20. The grinding member of claim 14 wherein the grooves are equally spaced about the annular surface portion.

21. The grinding member of claim 14 wherein the grooves are arranged in spaced groupings about the annular surface portion.

22. The grinding member of claim 14 wherein the passage through the annular member is a threaded passage.

23. The grinding member of claim 14 wherein the selected ones of said circumferentially spaced surface portions on which are formed a layer of particles of a relatively hard wear resistant material in a binder are separated by other surface portions without such particle layers formed thereon.

24. Means for grinding frusto-conical shaped annular valve seat surfaces comprising an elongated housing member having spaced opposite ends and a chamber formed extending therebetween, means on one end of the housing member for coupling a source of rotational energy thereto, an annular grinding member and means on the opposite end of the housing member for mounting the grinding member thereon, said grinding member being formed of metal and having an annular frusto-conical shaped surface formed on one end thereof at an angle that corresponds to the angular orientation of a valve seat surface to be ground, at least two spaced surface grooves formed extending across the annular frusto-conical shaped surface at spaced locations therearound, a layer of relatively hard wear resistant abrasive particles and a binder formed on said frusto-conical shaped surface for engaging a valve seat surface to be ground thereby, and means to support said housing member with the metal grinding member mounted thereon in position such that the layer of abrasive particles engages the valve seat surface to be ground.

25. The means defined in claim 24 wherein the means to support said housing member with the grinding member mounted thereon includes a member positioned in the housing and journalled for rotation relative thereto, said member having a cylindrical passage formed therein.

26. The means defined in claim 25 wherein the grinding member is substantially annular in shape and has an axial passage extending therethrough, cooperatively engagable means on the housing member and on the grinding member for axially aligning the grinding member on the housing member.

27. The means defined in claim 24 wherein the means on one end of the housing member for coupling to a source of rotational energy includes means forming a polygonal shaped cavity in the housing member adjacent to the one end thereof and a coupling member including an elongated first portion for connecting to a source of rotational energy and a second polygonal shaped portion positioned in the polygonal shaped housing cavity, and means to permit limited angular and axial relative movement between the coupling member and the housing member.

28. The means defined in claim 24 wherein the other housing end has an endwardly extending portion with external threads formed thereon, said grinding member having a passage therethrough which is threaded to cooperate with the threads on the other housing end.

29. The means defined in claim 24 including an elongated member having a cylindrical portion adjacent one end thereof and a second portion adapted to be positioned extending into a valve guide and means positioned in said housing member for making sliding engagement with the cylindrical portion of said elongated member to locate the grinding member relative to a valve seat surface to be ground.

30. The means defined in claim 24 wherein the housing chamber is substantially filled to increase the moment of inertia thereof.

31. The means defined in claim 30 wherein the housing chamber is substantially filled with metallic particles.

32. The means defined in claim 30 wherein the housing chamber is substantially filled with a liquid substance.

33. Means for grinding annular frusto-conical shaped valve seat surfaces comprising a housing structure having first and second relatively rotatable portions and spaced first and second opposite ends, means at said first end for coupling the first housing portion to a source of rotational energy, an annular metal grinding member having an axial extending bore therethrough defined in part by a threaded portion and in part by an annular groove adjacent one end thereof, means adjacent to the second housing end including a threaded portion for cooperating with the threaded bore portion of the grinding member an an annular portion for simultaneously cooperatively engaging the annular groove, said metal grinding member having a frusto-conical shaped end surface formed thereon at an angle that corresponds to the angular orientation of a valve seat surface to be ground, said frusto-conical shaped end surface extending between spaced inner and outer peripheral edges and having a plurality of circumferentially spaced grooves formed therein extending between the spaced peripheral edges dividing the surface into a plurality of surface portions, and a layer formed of relatively hard wear resistant abrasive particles and a binder formed on selected ones of the surface portions.

34. The means defined in claim 33 wherein a chamber is formed in this housing structure between the first and second portions and means positioned in the chamber to increase the moment of inertia of the housing structure.

* * * * *

UNITED STATES PATENT OFFICE

CERTIFICATE OF CORRECTION

Patent No. 4,467,566 Dated August 28, 1984

Inventor(s) Joseph F. Ondrus, Jr. and John J. Schimweg

It is certified that error appears in the above-identified patent and that said Letters Patent are hereby corrected as shown below:

Column 3, line 68 "engagihg" should be --engaging--.

Column 12, line 60 "an an" should be --and an--.

Signed and Sealed this

*Twenty-second* Day of *January 1985*

[SEAL]

*Attest:*

DONALD J. QUIGG

*Attesting Officer* *Acting Commissioner of Patents and Trademarks*